US010895124B2

(12) United States Patent
Chapman et al.

(10) Patent No.: US 10,895,124 B2
(45) Date of Patent: Jan. 19, 2021

(54) COLLIDING TOOL

(71) Applicant: SPEX CORPORATE HOLDINGS LTD., Aberdeen (GB)

(72) Inventors: Barry Chapman, Aberdeenshire (GB); Simon McKay, Banchory (GB); Andrew Pettitt, Aberdeenshire (GB); Jamie Oag, Aberdeenshire (GB); Rae Younger, Aberdeenshire (GB)

(73) Assignee: SPEX CORPORATE HOLDINGS LTD., Aberdeen (GB)

( * ) Notice: Subject to any disclaimer, the term of this patent is extended or adjusted under 35 U.S.C. 154(b) by 175 days.

(21) Appl. No.: 16/079,393

(22) PCT Filed: Feb. 22, 2017

(86) PCT No.: PCT/GB2017/050459
§ 371 (c)(1),
(2) Date: Aug. 23, 2018

(87) PCT Pub. No.: WO2017/144878
PCT Pub. Date: Aug. 31, 2017

(65) Prior Publication Data

US 2019/0055803 A1 Feb. 21, 2019

(30) Foreign Application Priority Data

Feb. 24, 2016 (GB) ..... 1603222.9

(51) Int. Cl.
*E21B 29/02* (2006.01)
*F42C 19/12* (2006.01)
*F42D 1/04* (2006.01)

(52) U.S. Cl.
CPC ..... *E21B 29/02* (2013.01); *F42C 19/12* (2013.01); *F42D 1/043* (2013.01)

(58) Field of Classification Search
CPC ..... E21B 29/02; F42C 19/12; F42D 1/043
See application file for complete search history.

(56) References Cited

U.S. PATENT DOCUMENTS 4,211,290 A * 7/1980 Mason ..... E21B 17/07 175/321
4,378,844 A * 4/1983 Parrish ..... F42D 1/04 102/313

(Continued)

FOREIGN PATENT DOCUMENTS

WO 00/45099 A2 8/2000
WO 2014/204891 A1 12/2014

OTHER PUBLICATIONS

PCT International Search Report and Written Opinion for corresponding International Application Serial No. PCT/GB2017/050459, dated Aug. 21, 2017, pp. 1-22.

(Continued)

*Primary Examiner* — Caroline N Butcher
(74) *Attorney, Agent, or Firm* — Tarolli, Sundheim, Covell & Tummino LLP

(57) ABSTRACT

A colliding tool for severing a target in a wellbore as described. The tool comprises a housing having a first chamber, the first chamber containing an explosive charge; and an at least one detonator connected to the explosive charge, the at least one detonator being insulated from temperature in the wellbore. In use, the at least one detonator is configured to simultaneously initiate a first explosion at a first end of the explosive charge and a second explosion at a second end of said explosive charge.

31 Claims, 3 Drawing Sheets

(56) References Cited

U.S. PATENT DOCUMENTS

| | | | | |
|---|---|---|---|---|
| 5,046,563 | A | 9/1991 | Engel et al. | |
| 5,123,356 | A | 6/1992 | Brooks et al. | |
| 5,589,657 | A | 12/1996 | Gessel et al. | |
| 6,009,811 | A * | 1/2000 | Newman | E21B 29/02 102/312 |
| 2002/0084913 | A1* | 7/2002 | Hudson | E21B 47/121 340/853.1 |
| 2003/0047312 | A1 | 3/2003 | Bell | |
| 2004/0140090 | A1* | 7/2004 | Mason | E21B 17/07 166/242.1 |
| 2007/0234921 | A1* | 10/2007 | Han | F42B 39/18 102/331 |
| 2009/0090263 | A1 | 4/2009 | Han et al. | |
| 2017/0101693 | A1* | 4/2017 | Lomker | C21D 9/14 |

OTHER PUBLICATIONS

UKPO Combined Search and Examination Report under sections 17 and 18(3) for corresponding Application Serial No. GB1702932.3, dated Jun. 26, 2017, pp. 1-7.

* cited by examiner

COLLIDING TOOL

RELATED APPLICATIONS

The present invention is a U.S. National Stage under 35 USC 371 patent application, claiming priority to Serial No. PCT/GB2017/050459, filed on 22 Feb. 2017; which claims priority from 1603222.9, filed 24 Feb. 2016, the entirety of both of which are incorporated herein by reference.

FIELD OF THE INVENTION

The present invention relates to the technical field of earth drilling, particularly, but not limited to, earth drilling for extracting oil and/or gas from beneath the earth's surface, although it can also find application in well completions and oil and/or gas production operations. The present invention is particularly suitable for severing a stuck drill string (drill pipe and drill collars) during drilling operations.

BACKGROUND TO THE INVENTION

Oil and gas reserves can be located at great depths beneath the earth's surface. Drilling deep wells in the earth is the state-of-the-art method for retrieving and utilising such reserves. In order to drill at such great depths, drill strings, consisting of a drill bit and a very long drill string, are used in conjunction with the appropriate drilling equipment. Such drilling operations are a technical challenge for drilling engineers who might encounter many problems and drawbacks during the drilling of a well.

A common problem encountered while drilling an oil or gas well is that the drill string gets stuck in the borehole, for example, as a result of a large section of wellbore wall collapsing into it. In some cases, the drilling equipment cannot exert enough force to rotate, pull or push the drill string and the only viable option to resume the drilling operation is to sever the drill string close to the point where the drill string is stuck and then fish, or otherwise attempt to recover, the trapped drill string section.

On many occasions the drill string gets stuck at very great depths within the wellbore and severing the drill string is then a challenge. Explosive drill string severing tools are commonly used for this. These tools incorporate a column of explosives which is simultaneously initiated at each end, the two shock waves that are created converge through the explosive charge, meeting in the centre of the charge and the resultant combined shock wave is directed radially outwards. The resultant combined shock wave has an enhanced value greater than that of the constituent shock waves. The resultant combined shockwaves, along with instantaneous gas liberation produced by the explosion severs the stuck drill string. This mechanism can be referred to as the collision effect and is used in colliding tools.

However, one drawback of colliding tools is that if both detonations do not occur simultaneously, the destructive effect of the colliding tool is reduced, and it has been known that energy created in the colliding tool is insufficient to rupture the colliding tool housing. This can lead to an over-pressurised situation within the colliding tool, which represents a significant risk should the colliding tool subsequently rupture. Similarly if the tool is stuck in a well for an extended period and beyond its planned design limits, well fluids may ingress into the tool. Both scenarios may potentially lead to an over-pressurised tool, resulting in potential risk to personnel and assets when the colliding tool is retrieved to surface and if suitable precautions and/or tool design features are not in place.

Furthermore, as more and more challenging oil and gas wells are drilled, higher and higher pressures and temperatures are being encountered. Particular challenges are experienced when drilling high pressure-high temperature (HPHT) wells where it is the combination of high pressures and high temperatures that cause specific engineering and operational challenges. In particular, equipment items fail at these high pressures and temperatures. For example at high temperatures electronic equipment starts to fail. These challenges are compounded by spatial restrictions in the wellbore.

SUMMARY OF THE INVENTION

According to a first aspect of the invention there is provided a colliding tool for severing a target in a wellbore, the tool comprising:

a housing having a first chamber, the first chamber containing an explosive charge; and an at least one detonator connected to the explosive charge, the at least one detonator being insulated from temperature in the wellbore;

wherein, in use, the at least one detonator is configured to simultaneously initiate a first explosion at a first end of the explosive charge and a second explosion at a second end of said explosive charge.

Insulating the at least one detonator from the temperature in the well prevents the/each detonator initiating prematurely or failing to detonate. Where there are multiple detonators, by insulating the/each detonators such that one or both detonators do not detonate prematurely or fail to detonate, it reduces the possibility of an over-pressurised colliding tool situation.

The at least one detonator may be a single detonator. By using a colliding tool with a single detonator connected to two opposite ends of an explosive charge, two explosions are initiated simultaneously or, when the detonator is defective, no explosions are initiated at all. This arrangement eliminates the risk of an over-pressurised tool.

Optionally, where there is a single detonator, the detonator may be connected to opposite ends of the explosive charge by two separate strands of a detonating cord of equal length.

Alternatively, where there is a single detonator, the detonator may be connected to opposite ends of the explosive charge by a strand of detonating cord which bifurcates into two strands of detonating cord of equal length. These methods of connecting the detonator to the explosive charge ensure that the two explosions are initiated simultaneously at opposite ends of the explosive charge because the detonation is transmitted at a constant speed through the detonating cord or fuse.

The at least one detonator may be positioned closer to one end of the explosive charge than the other. Due to the space restriction in a wellbore environment, the at least one detonator may be positioned in series with the explosive charge along a colliding tool axis.

In such an embodiment, a strand of detonating cord connected to a proximal end of the explosive charge may be coiled.

Alternatively or additionally, the strand of detonating cord may be wound around a mandrel. Connecting the detonating cord strand to the proximal end of the explosive charge in this way is intended to be compact so that the detonating cord fits into a small space in the colliding tool.

In these and other embodiments where a strand of detonating cord is coiled or where a portion of a strand of detonating cord is positioned adjacent to another portion of a strand of detonating cord, the tool may further comprise a barrier to prevent a detonation bypassing any length of the detonating cord. The barrier may, for example, be a thin walled tube.

The colliding tool may comprise a second chamber for housing the/each detonator. Such an arrangement has improved safety characteristics because the explosives and the/each detonator are kept in different housings. This permits the housings to be assembled and stored in separate locations and only be connected prior to deployment downhole.

The colliding tool may further comprise a bridging piece connecting the first and second chambers.

Each chamber may define an angled face, the angled face abutting a complementary angled face defined by the bridging piece. This arrangement prevents the chamber from splaying outwards and is intended to retain the pressure tight integrity of the colliding tool housing assembly when subjected to compressive loading along the axis of this assembly produced by the hydrostatic pressure at operating depth within the well.

The first chamber may comprise a thin walled high yield steel. A thin walled tool maximises the volume of explosives that can be loaded within a given outside diameter of the tool. The high yield steel may be used to keep the outside diameter of the tool the same which allows the high yield steel to reach high pressures for a given low outside diameter.

Additionally, the second chamber may comprise a thin walled high yield steel.

The/each detonator may be insulated from wellbore temperature by a thermally insulated device.

The/each detonator may be stored within the thermally insulated device.

The thermally insulated device may comprise a vacuum flask.

The vacuum flask may be located within a metallic housing or container.

The tool housing may form part or all of the thermally insulated device.

The thermally insulated device may comprise a temperature insulating material such as graphene, foam or aerogel or the like.

Preferably the metallic housing or container is made of aluminium.

The colliding tool may be activated from any suitable location and the signal may be in any suitable form. For example, it could be activated from an onshore or offshore drilling rig, or a fixed or mobile offshore platform using a hard-wired voltage or an acoustic signal sent to a receiver and a discharge unit which is integral to the tool itself.

The colliding tool may define a signal path to permit a signal to pass through at least a portion of the tool to the/each detonator.

In some embodiments, the signal will be an electrical signal.

The thermally insulated device may form part of the signal path. As space is at a premium, utilising components within the colliding tool to transfer the signal, as opposed to running a signal conduit such as a wire through the tool, maximises the space available within the colliding tool.

Preferably the metallic housing acts as a detonating signal transmission means.

The thermally insulated device may be electrically isolated from the colliding tool housing to prevent a short circuit with the tool housing.

The thermally insulated device may be attached to the tool housing by a mounting.

The mounting may comprise a high temperature insulating material.

The mounting may form part of the signal circuit path, the detonation signal being passed through the mounting to the thermally insulated device.

The colliding tool may comprise one or more springs located in the first chamber to compress and/or restrain the explosive charge.

The colliding tool may comprise a pressure relief means.

The pressure relief means may comprise a pressure relief valve. The pressure relief means may be used in the event that failure of the colliding tool results in a pressurised situation within the colliding tool.

Alternatively or additionally, the pressure relief means may comprise a bleeder valve assembly.

Alternatively or additionally, the pressure relief means may comprise a pressure relief plug.

Alternatively or additionally, the pressure relief means may comprise a bursting disc.

The colliding tool may comprise a shock attenuating mandrel. A shock attenuating mandrel is useful for keeping the colliding tool in the desired position during the detonation and to protect surrounding downhole equipment and the colliding tool itself from shocks or collisions caused by the explosions.

The shock attenuating mandrel may be deformable by the explosions, thereby absorbing energy.

The shock attenuating mandrel may comprise formations and recesses to direct its deformation by the explosions into a predetermined shape.

The shock attenuating mandrel may comprise a concertina shaped tubular section.

Alternatively or additionally, the shock attenuating mandrel may comprise a deformable elastomer.

Alternatively or additionally the shock attenuating mandrel may comprise a spring.

In some embodiments, the colliding tool may include a mechanism to facilitate failure of the colliding tool target. The failure mechanism may pre-cool the target using a cooling agent such as nitrogen (N2) or carbon dioxide (CO2). The energy required to fracture a cold steel target is lower than an identical warm target. This would allow a smaller tool with a smaller explosive charge loading to be used, giving the associated benefits.

The failure mechanism may impart additional forces into the target. Additional forces (tension, hoop etc.) would reduce the overall explosive force required to sever the target. For example, in one embodiment, the drill string could be pulled from surface before the tool is fired. Alternatively, the colliding tool may locally increase tension or pressure to stretch or similar the pipe. On firing, the explosive just needs to provide the remainder of the forces to sever the target. If, for example, additional tension is added it is believed it may be possible to cause the pipe to fail in tension rather than the ballooning hoop stress currently employed.

The first chamber may be defined by a housing wall.

In some embodiments the housing wall includes a thinned portion. A thinned portion allows more of the explosive energy to go into the target and minimises energy losses in the tool housing.

The thinned portion may be a circumferential groove.

The circumferential groove may be machined on the internal surface of the first chamber.

The tool may include an explosive lens. An explosive lens (air cavity, plastic, slower explosive etc.) may allow the shockwave to become planar sooner. This would reduce the overall length of the explosives. An explosive lens could also act to focus the shockwave into a smaller diameter at the mid-point of the explosive charge in the tool first chamber. This may locally increase the peak pressures and the explosive effect. This would allow a smaller overall tool size that can still sever the required targets. Net Explosive Quantity is reduced, which improves overall tool safety.

The tool may include a plurality of seals to prevent fluid ingress and flooding as fluids may affect the explosive charge and cause the tool to become inoperable or ineffective when detonated.

The seals may be elastomeric or metal to metal sealing or any suitable sealing arrangement.

The explosive charge may be a propellant.

In some embodiments the/each detonator may initiate a third explosion, fourth explosion etc. in the explosive charge.

The first chamber may include spacers to brace the chamber against the external well pressure. Such an arrangement permits the wall to be thinner and this lets more of the available energy reach the target.

The colliding tool may be pressure balanced such that pressure within the first chamber is substantially equal to the pressure out with the tool. Such an arrangement would increase the space available for the explosive charge.

In some embodiments a non-conductive fluid or gel is introduced into the first chamber. Such arrangements increase performance of explosives as they perform better in the fluid than in gas.

The colliding tool may comprise sensing equipment to locate a feature or an obstacle which could impact positively or negatively on the severance of the target. In an embodiment where the target is a drill string, the sensing equipment may be arranged to sense casing collars or drill string joints or the like.

The sensing equipment may include pulse eddy current generators or generators of magnetic fields.

According to a second aspect of the present invention there is provided a colliding tool comprising a first chamber containing an explosive charge and at least one detonator connected to the explosive charge to simultaneously initiate an explosion at one end of the explosive charge and another explosion at an opposite end of said explosive charge wherein the colliding tool comprises a pressure relief means for the explosive chamber.

According to a third aspect of the present invention there is provided a colliding tool comprising a first chamber containing an explosive charge and at least one detonator connected to the explosive charge to simultaneously initiate an explosion at one end of the explosive charge and another explosion at an opposite end of said explosive charge wherein the colliding tool comprises a shock attenuating mandrel adapted to absorb energy from the explosions.

According to a fourth aspect of the present invention there is provided a method of severing a target in a wellbore, the method comprising:

disposing a tool adjacent a target to be severed in a wellbore, the tool having a housing, the housing having a first chamber, the first chamber containing an explosive charge, and an at least one detonator connected to the explosive charge, the at least one detonator being insulated from temperature in the wellbore; and simultaneously detonating a first explosion at a first end of the explosive charge and a second explosion at a second end of the explosive charge.

Embodiments of the second, third or fourth aspects of the invention may comprise one or more features of the first aspect of the invention or the embodiments associated with the first aspect of the invention.

BRIEF DESCRIPTION OF THE DRAWINGS

Embodiments of the present invention will now be described, by way of example only, with reference to the accompanying drawings, in which.

DETAILED DESCRIPTION OF THE DRAWINGS

Figure 1:
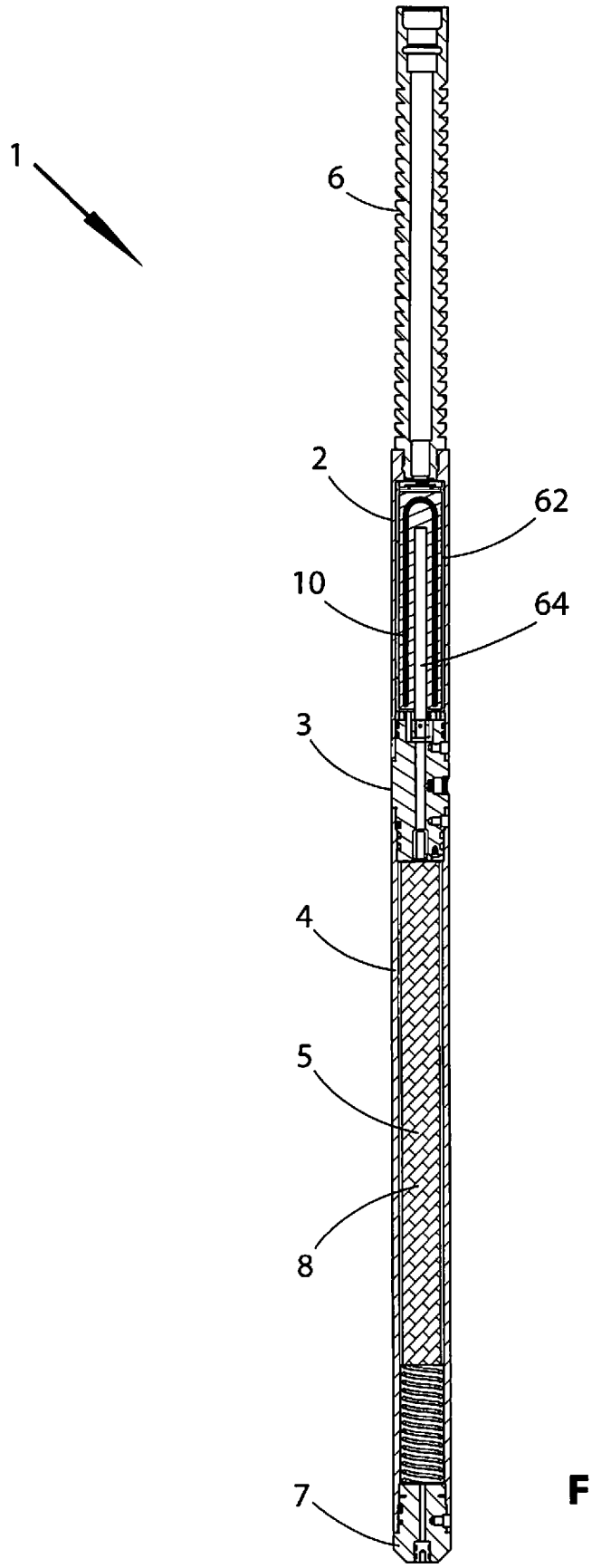
FIG. 1 is a section of a colliding tool according to an embodiment of the present invention.

Referring first to FIG. 1, a section of a colliding tool, generally indicated by reference numeral 1, is shown, according to an embodiment of the present invention. The colliding tool 1 comprises a first chamber 4, which is an explosives chamber 8 that contains an explosive charge 5, a second or detonator chamber 2 that contains a vacuum flask 10 housing a detonator 64. The vacuum flask 10 is within a metallic casing 62, wrapped with electrically insulating tape in order to insulate it from the second chamber 2. By placing the vacuum flask 10 within the metallic casing 62, the vacuum flask 10 is protected against the high-pressure environments found in deep oil wells, particularly in HPHT wells. The metallic casing 62 provides mechanical support and strength to the vacuum flask 10 and prevents the flask 10 being broken or shattered within the second chamber 2. The metallic casing 62 is wrapped with temperature-resistant electrically insulating tape such as Kapton™ tape.

The colliding tool 1 further comprises a bridging piece 3 connecting the first chamber 4 and the second chamber 2, and a concertina shaped shock attenuating mandrel 6 located above the second chamber 2.

Figure 2:
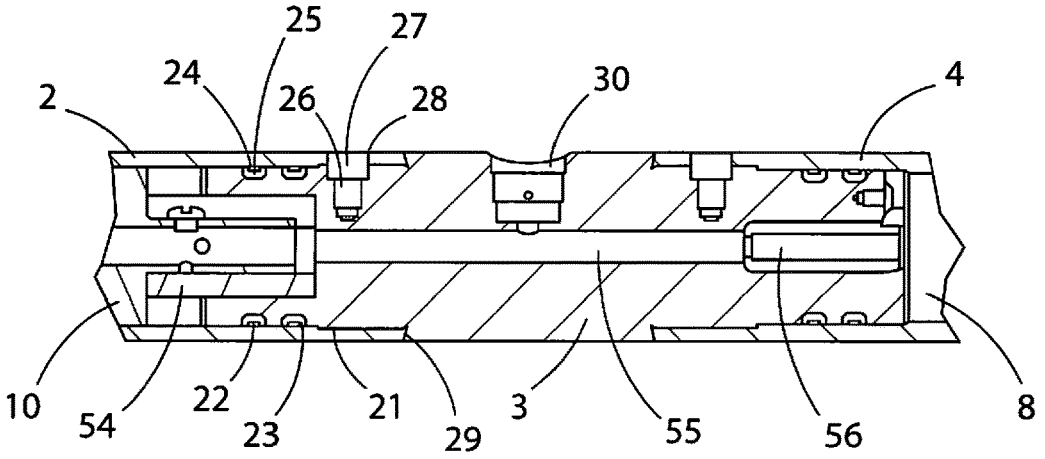
FIG. 2 is a detailed view of the bridging piece of the embodiment shown in FIG. 1.

Referring now to FIG. 2 some constructional features of the colliding tool 1 according to the present invention will be described. FIG. 2 represents the bridging piece 3 of FIG. 1 and shows how it is connected to the chambers 2, 4.

The second chamber 2 fits onto a bridging piece recess 21. The bridging piece recess 21 defines two circumferential grooves 22, 23, each groove accommodating an O-ring 24 and an anti-extrusion ring 25.

The bridging piece recess 21 further defines a threaded hole 26 which receives a hexagonal socket head cap screw 27 which passes through a hole 28 in the wall of the second chamber 2, connecting and securing the second chamber 2 to the bridging piece 3. One or more such threaded connections may be used to secure the second section 2 to the bridging piece 3.

The interface 29 between the second chamber 2 and the bridging piece 3 is angled at 10° from a perpendicular to the tool longitudinal axis. This interface arrangement captures the end of the second chamber 2, preventing the end of the second chamber 2 splaying out during detonation. An identical connection is made between the bridging piece 3 and the first chamber 4, and the first chamber 4 and a tool end cap 7.

The bridging piece 3 also comprises a port 30 to receive a bleeder valve assembly (not shown). The purpose of this bleeder valve assembly is to allow any trapped pressure in the tool to be safely relieved, should a pressure relief plug (discussed in due course in connection with FIG. 3) malfunction or not be used (by designing and manufacturing an end cap 7 with no pressure relief plug 9).

Figure 3:
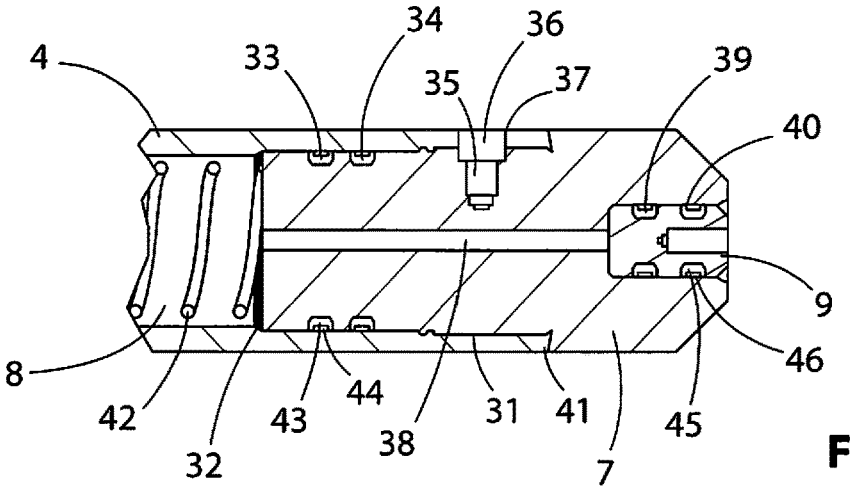
FIG. 3 is a detailed view of the end cap of the embodiment shown in FIG. 1.

Referring now to FIG. 3 additional constructional features of the colliding tool 1 according to the present invention will be described. The end cap 7 has an exterior recess 31 that fits into an interior recess 32 of the first chamber 4. The end cap 7 has two circumferential grooves 33, 34 on the recessed portion. Each groove 33, 34 accommodates an O-ring 43 and an anti-extrusion ring 44.

The end cap interior recess 32 further defines a threaded hole 35 that receives a hexagonal socket head cap screw 36 which passes through a hole 37 in the wall of the first chamber 4, connecting and securing the first chamber 4 to the end cap 7. One or more such threaded connections may be used to secure first chamber 4 to end cap 7.

The end cap 7 has a longitudinal hole 38 that connects the explosives chamber 8 (the first chamber 4) with the exterior of the colliding tool 1 for receiving a pressure relief plug 9. The pressure relief plug 9 has two circumferential grooves 39, 40 on its side and has been phosphate coated before assembling. Each groove accommodates an O-ring 45 and an anti-extrusion ring 46.

In use, the first chamber 4 may be held at atmospheric pressure. When the colliding tool 1 is deployed into a well, the pressure outside the colliding tool 1 is greater than the pressure inside the first chamber 4 and this pressure difference keeps the pressure relief plug 9 in place.

In the event that failure of the colliding tool 1 results in a pressurised situation within the first chamber 4, the colliding tool 1 must be slowly lifted and when the colliding tool 1 reaches a position in the well where the pressure is lower than the pressure within the first chamber 4, the pressure relief plug 9 will open and relieve the pressure inside the first chamber 4, until the pressure within the first chamber 4 is in equilibrium with the environmental pressure.

The compression spring 42, which is used to compress the explosive charge 5 is also visible in FIG. 3.

The colliding tool 1 of the above-described embodiment is capable of withstanding well pressures of 25,000 psi (172,368,932 Pa) and temperatures of 450 to 500° F. (232 to 260° C.) and is therefore suitable to be used in the so-called high pressure-high-temperature wells and therefore can be considered a HPHT colliding tool 1.

Figure 4:
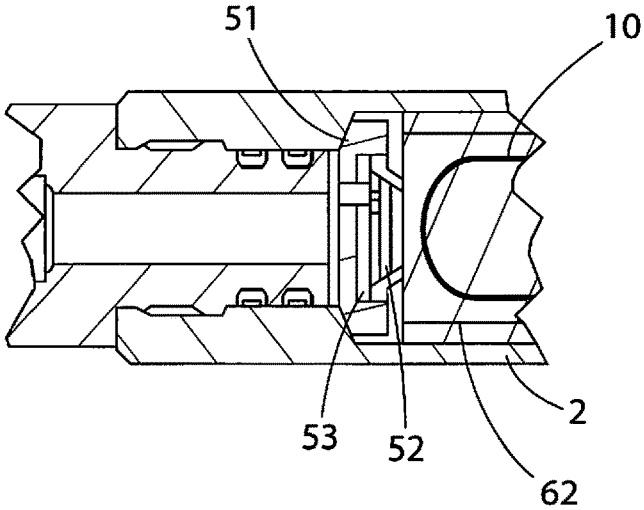
FIG. 4 is a detailed view of the connection of the detonator vacuum flask of the embodiment shown in FIG. 1.

Referring to FIG. 4, the end of the second chamber 2 opposite the bridging piece 3 is shown. This part of the colliding tool 1 includes a mounting 51 at one end of the metallic casing 62, which is insulated from the second chamber 4 by a surrounding layer of electrically insulating tape (not visible). By wrapping the metallic casing 62 with a temperature-resistant electrically insulating tape, as will be described, a detonating signal may be transmitted through the metallic casing 62 without being transmitted or lost to adjacent colliding tool parts and the temperature-resistant electrically insulating tape will not melt at the temperatures found in HPHT wells.

Figure 5:
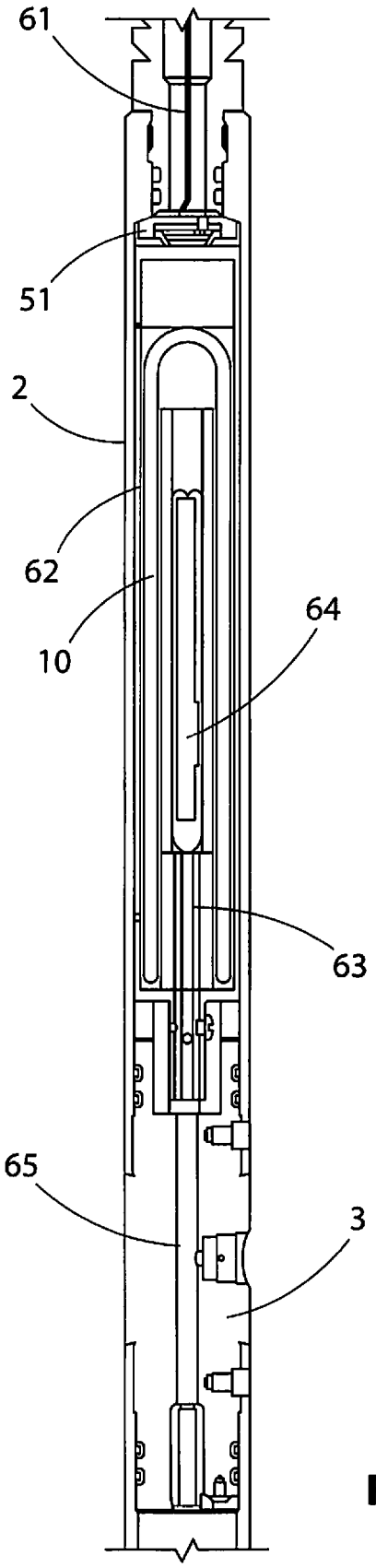
FIG. 5 is a detailed view of the circuit that follows an electrical detonating signal when the colliding tool is in use.

The mounting 51 is a plastic cup made of PEEK (Polyether-ether-ketone, a high temperature resistant insulating material), attached to an electric spring contact 52, which is supported on a contact plate 53 made of 316 stainless steel. The tool 1 is connected to surface by a first cable 61 (see FIG. 5), which, in turn, is connected to the contact plate 53.

Referring now to FIG. 1, FIG. 2, FIG. 4 and FIG. 5, the operation of the colliding tool 1 will now be described.

In operation, a positive electrical signal from surface passes to the contact plate 53 through the first cable 61. The signal is then passed to the metallic casing 62 through the contact plate 53. The advantage of transmitting the electrical detonation signal through the metallic casing 62 is that there is no need to use cables in the chamber 2 that houses the metallic housing and this is an advantage because the internal space available within the colliding tool 1 is restricted by the diameter of the colliding tool 1 which is constrained by the pressure it must withstand and the internal diameter of the wellbore and/or wellbore restriction it needs to pass through.

At the mouth of the metallic casing 62 (FIG. 5), a second cable 63 receives the positive signal and transmits it to the detonator 64, which is stored within the vacuum flask 10. It will be noted there is a sleeve 54 (see FIG. 2) over the vacuum flask mouth to insulate this part of the vacuum flask 10 from the second chamber 2 to prevent a short circuit.

The detonator 64 is fired and the explosive output from the detonator 64 is transferred by a detonating cord 65 through a hole 55 (FIG. 2) in the bridging piece 3 towards the first chamber 4 containing the explosive charge 5.

At the end of the bridging piece 3 nearest to the first chamber 4, the detonating cord 65 splits into two strands of equal length (not shown). One strand is connected to the furthest end of the explosive charge 5 and the other is connected to the nearest end of the explosive charge 5. The strand of detonating cord 65 connected to the end of the explosive charge 5 closest the bridging piece 3 is coiled or wound around a mandrel 56 so that it takes less space within the colliding tool 1.

The explosive charge 5 detonates and the shockwave created at each end travels through the column of explosive charge 5 until the shockwaves meet in the middle where a perpendicular shockwave may be emitted from the colliding tool 1 to sever the stuck pipe.

When the explosions take place, energy is absorbed by a controlled deformation of the shock attenuating mandrel that collapses and forms a shorter mandrel, thereby absorbing an important part of the explosions' energy and preventing or reducing its transmission through the tubular string upwards, which otherwise might be dangerous and harmful to other equipment located above the colliding tool 1.

The present invention provides a colliding tool 1 useful for severing stuck drill string or other stuck downhole parts in HPHT wells. The colliding tool 1 comprises improved safety features like a single detonator, a pressure relief plug and separated compartments for the detonator and explosive charge. Simultaneous explosions at opposite ends of the explosive charge are achieved by using strands of detonating cord of equal length.

Various modifications may be made within the scope of the invention as herein described, and embodiments of the invention may include combinations of features other than those expressly described.

For example, in alternative embodiments, the detonator may fire a single strand of detonating cord that may be divided in two strands of equal length when the detonating cord enters the explosives chamber. In further alternatives, there may be multiple separate detonators.

Further, although the plastic cup is described as being made of PEEK any suitable high-temperature insulating material may be used.

The tool may be phosphate coated. This enhances the resistance against corrosion of the colliding tool.

The invention claimed is:

1. A colliding tool for severing a target in a wellbore, the tool comprising:

a housing having a first chamber, the first chamber containing an explosive charge;

an at least one detonator connected to the explosive charge, the at least one detonator being insulated from temperature in the wellbore by a thermally insulated device; and a signal path including an electrical signal path, the signal path permitting a signal to pass through at least a portion of the tool to the at least one detonator, a metallic housing or container of the thermally insulated device forming part of the electrical signal path to the detonator;

wherein, in use, the at least one detonator is configured to simultaneously initiate a first explosion at a first end of the explosive charge and a second explosion at a second end of said explosive charge.

2. The colliding tool of claim 1, wherein the at least one detonator is a single detonator.

3. The colliding tool of claim 2, wherein, where there is a single detonator, the detonator is connected to opposite ends of the explosive charge by two separate strands of a detonating cord of equal length.

4. The colliding tool of claim 2, wherein, where there is a single detonator, the detonator is connected to opposite ends of the explosive charge by a strand of detonating cord which bifurcates into two strands of detonating cord of equal length.

5. The colliding tool of claim 1 wherein the at least one detonator is positioned closer to one end of the explosive charge than the other.

6. The colliding tool of claim 5, wherein a strand of detonating cord connected to a proximal end of the explosive charge is coiled.

7. The colliding tool of claim 5, wherein a strand of detonating cord is wound around a mandrel.

8. The colliding tool of claim 1, wherein the tool further comprises a second chamber for housing the at least one detonator, the first and second chambers being connected by a bridging piece.

9. The colliding tool of claim 8, wherein each chamber defines an angled face, the angled face abutting a complementary angled face defined by the bridging piece.

10. The colliding tool of claim 1, wherein the first chamber comprises a thin walled high yield steel.

11. The colliding tool of claim 10, wherein the tool further comprises a second chamber for housing the at least one detonator, the first and second chambers being connected by a bridging piece, wherein the second chamber comprises a thin walled high yield steel.

12. The colliding tool of claim 1, wherein the at least one detonator is stored within the thermally insulated device.

13. The colliding tool of claim 12, wherein the thermally insulated device comprises a vacuum flask located within the metallic housing or container.

14. The colliding tool of claim 1, wherein the tool housing forms part or all of the thermally insulated device.

15. The colliding tool of claim 1, wherein the thermally insulated device comprises a temperature insulating material selected from a graphene, a foam, and an aerogel.

16. The colliding tool of claim 1, wherein the thermally insulated device is electrically isolated from the colliding tool housing to prevent a short circuit with the tool housing.

17. The colliding tool of claim 1, wherein the thermally insulated device is attached to the tool housing by a mounting.

18. The colliding tool of claim 17, wherein the mounting comprises a high temperature insulating material.

19. The colliding tool of claim 17, wherein the mounting forms part of the signal circuit path, the detonation signal being passed through the mounting to the thermally insulated device.

20. The colliding tool of claim 1, wherein the colliding tool comprises a shock attenuating mandrel.

21. The colliding tool of claim 20, wherein the shock attenuating mandrel comprises a concertina shaped tubular section.

22. The colliding tool of claim 20, wherein the shock attenuating mandrel comprises a deformable elastomer.

23. The colliding tool of claim 20, wherein the shock attenuating mandrel comprises a spring.

24. The colliding tool of claim 1, wherein the first chamber is defined by a housing wall.

25. The colliding tool of claim 24, wherein the housing wall includes a thinned portion.

26. The colliding tool of claim 25, wherein the thinned portion is a circumferential groove.

27. The colliding tool of claim 26, wherein the circumferential groove is machined on the internal surface of the first chamber.

28. The colliding tool of claim 1, wherein the explosive charge is a propellant.

29. The colliding tool of claim 1, wherein the colliding tool comprises sensing equipment to locate a feature or an obstacle which could impact positively or negatively on the severance of the target.

30. The colliding tool of claim 29, wherein the sensing equipment includes pulse eddy current generators or generators of magnetic fields.

31. A method of severing a target in a wellbore, the method comprising: disposing a tool adjacent a target to be severed in a wellbore, the tool having a housing, the housing having a first chamber, the first chamber containing an explosive charge, and an at least one detonator connected to the explosive charge, the at least one detonator being insulated from temperature in the wellbore by a thermally insulated device; transmitting a signal along a signal path including an electrical signal path, the signal path permitting a signal to pass through at least a portion of the tool to the at least one detonator, a metallic housing or container of the thermally insulated device forming part of the electrical signal path to the detonator; and simultaneously detonating a first explosion at a first end of the explosive charge and a second explosion at a second end of the explosive charge.

* * * * *